US005421372A

United States Patent [19]

Hsu

[11] Patent Number: 5,421,372

[45] Date of Patent: Jun. 6, 1995

[54] METHOD AND APPARATUS FOR WEAVING ARTICLES ON A LOOM IN A PLURALITY OF WIDTHS

[75] Inventor: You-Chung Hsu, Taipei, Taiwan, Prov. of China

[73] Assignee: Am-Mark Label, Inc., Covina, Calif.

[21] Appl. No.: 184,948

[22] Filed: Jan. 21, 1994

[51] Int. Cl.[6] ..... D03D 49/20

[52] U.S. Cl. ..... 139/35; 139/97; 139/304

[58] Field of Search ..... 139/22, 304, 97, 35, 139/302, 311; 242/118.2

[56] References Cited

U.S. PATENT DOCUMENTS

| | | | |
|---|---|---|---|
| 1,027,887 | 5/1912 | Owen . | |
| 3,461,920 | 8/1969 | Sakamoto | 139/302 |
| 3,522,700 | 8/1970 | Fisher | 242/118.2 |
| 4,404,997 | 9/1983 | Ushiro et al. | 139/302 |
| 4,691,742 | 9/1987 | Ushiro . | |

OTHER PUBLICATIONS

"Jacquard Narrow Fabric Loom Operation Manual"; Engineering Works Jakob Müller; Cover page, pp. 0:7, 1:4, 5:1-3, 5:5, 6:1-2; Sep. 1992.

*Primary Examiner*—Andrew M. Falik
*Attorney, Agent, or Firm*—Sheldon & Mak

[57] ABSTRACT

A method and apparatus for weaving woven articles in a plurality of widths includes the steps of providing a weaving machine having at least one weaving head and harnesses controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp threads in planes intersecting the first and second path planes, the slots being closely spaced and defining a maximum weaving width $W_M$ of the weaving head, the woven articles being serially collected from the weaving head; separating the warp strands from the reed member into a first group and a second group, the first group including sufficient warp strands for forming the woven articles at a predetermined weaving width $W_1$; feeding the strands of the first group into the weaving head for forming the woven articles having the predetermined with $W_1$; feeding the strands of the second group in a bypass path bypassing the woven articles; and maintaining a collection tension in the strands of the second group within the bypass path, the collection tension being sufficient for feeding the strands of the second group from the reed member in unison with the strands of the first group.

18 Claims, 2 Drawing Sheets

METHOD AND APPARATUS FOR WEAVING ARTICLES ON A LOOM IN A PLURALITY OF WIDTHS

BACKGROUND

The present invention is directed to weaving of the type producing garment labels and the like, and more particularly to methods and apparatus facilitating set-up of a loom for producing woven articles in different widths.

Garment labels and similar woven articles are often mass-produced on a gang-type loom having from 6 to 20 weaving heads, a programmed jacquard unit of the loom upstream of the weaving stations controlling the graphic content of the labels by operating guide harnesses for sequencing warp strands of warp yarn (which are known in the art as "warp ends") between intersecting path planes in intervals between passes of a weft needle, a slotted reed member reciprocally compacting a weft yarn following each cycle of the weft needle. Labels of various widths within a maximum weaving width can be produced by using less than a full complement of warp ends. Traditionally, set-up of the loom for a different label width requires complete rethreading of the loom, including substitution of a warp supply bobbin or "warp beam" having a new complement of warp strands. The rethreading is a massive undertaking in that each of the hundreds or thousands of strands must be threaded through a particular set of jacquard harnesses and a corresponding slot of an associated reed member, the rethreading typically requiring two workers, 2–3 days of intensive skilled labor with corresponding down-time of the loom. Further labor is required for readjusting a stop wire of each of the heads that automatically shuts down the loom in the event of yarn breakage.

In an effort to limit the need for warp beams having many different complements of warp strands, the prior art includes apparatus for collecting surplus warp strands of warp yarn from a warp beam. See, for example, U.S. Pat. No. 4,691,742 to Ushiro. Thus it is not required to change warp beams using the apparatus of Ushiro when setting up for a different width article to be woven. However, extensive rethreading of the loom itself is still required, particularly when there are multiple weaving stations. Also, the apparatus of the prior art for collecting surplus warp strands is ineffective for tensioning strands of different denier (weight per unit length), i.e., having different cross-sectional areas.

Thus there is a need for a way to switch between weaving widths of a loom, particularly a gang-type loom, while avoiding extensive rethreading of the loom.

SUMMARY

The present invention meets this need by providing for collection of unused warp strands downstream of loom reed members. In one aspect of the invention, a method for weaving woven articles in a plurality of widths includes the steps of:

(a) providing a weaving loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head;

(b) separating the warp strands from the reed member into a first group and a second group, the first group including sufficient warp strands for forming the woven articles at a predetermined weaving width $W_1$;

(c) feeding the strands of the first group into the weaving head for forming the woven articles of the predetermined width $W_1$;

(d) feeding the strands of the second group in a bypass path bypassing the woven articles; and (e) maintaining a collection tension in the strands of the second group within the bypass path, the collection tension being sufficient for feeding the strands of the second group from the reed member in unison with the strands of the first group.

The loom can operate at a warp rate of advancing the warp strands, the step of maintaining the collection tension including the steps of:

(a) providing a cylindrical warp collection roll for receiving the strands of the second group;

(b) rotating the collection roll using a drive capable of collecting the strands of the second group on the collection roll at a rate in excess of the warp rate; and (c) limiting a torque transmitted to the collection roll from the drive for maintaining the collection tension without exceeding a predetermined maximum tension of each of the strands of the second group.

The step of maintaining the collection tension can include the further step of periodically winding a sheet of flexible material on the warp collection roll between layers of the strands of the second group.

The step of limiting the torque can include using a slip clutch between the drive and the warp collection roll. The warp collection roll can be a primary warp collection roll, the strands of the second group including strands having a first cross-sectional area and strands having a different cross-sectional area, the step of maintaining the collection tension including the further steps of:

(a) separating the strands having a different cross-sectional area from the strands of the second group being received on the warp collection roll;

(b) providing a cylindrical secondary collection roll for receiving the strands of the second group having the different cross-sectional area;

(c) rotating the secondary collection roll using a coupling to the drive capable of collecting the strands having the different cross-sectional area at a rate in excess of the warp rate; and (d) limiting a torque transmitted to the secondary collection roll by the coupling for maintaining the collection tension without exceeding the predetermined maximum tension of each of the strands of the second group.

The step of limiting the torque can include the steps of using a slip clutch between the drive and the primary warp collection roll, and using an elastic belt in the coupling between the drive and the secondary collection roll. The step of separating the warp strands can include operating the harnesses for guiding the strands of the second group toward one only of the path planes.

In another aspect of the invention, an apparatus for facilitating weaving woven articles on the loom includes an auxiliary drive; a warp collection roll rotatably driven by the auxiliary drive; a torque limiter connected between the auxiliary drive and the warp collection roll; a separator for separating the warp strands into a first group and a second group, the first group including sufficient strands for forming the woven articles at a predetermined weaving width $W_1$, and for directing at least some of the strands of the second group in a bypass path bypassing the weaving head and onto the warp collection roll.

Preferably the apparatus further includes a resilient member on the warp collection roll that is variably compressed by the strands of the second group for equalizing tension applied to the strands of the second group. The apparatus can further include a leveling guide for periodically axially displacing the strands of the second group above the warp collection roll, the leveling guide being reciprocally driven from the auxiliary drive. The second group can include strands having a first cross-sectional area and strands having one or more different cross-sectional areas, the apparatus including at least one secondary collection roll in addition to the warp collection roll.

The loom can include a plurality of the weaving heads and corresponding reed members, the guide separating the warp strands from each of the reed members into respective first and second groups, at least some of the strands of each of the second groups being received on the warp collection roll. Preferably the separator includes the harnesses being positioned for guiding the strands of the second group toward one only of the path planes.

DRAWINGS

These and other features, aspects, and advantages of the present invention will become better understood with reference to the following description, appended claims, and accompanying drawings, where:

DESCRIPTION

Figure 1:
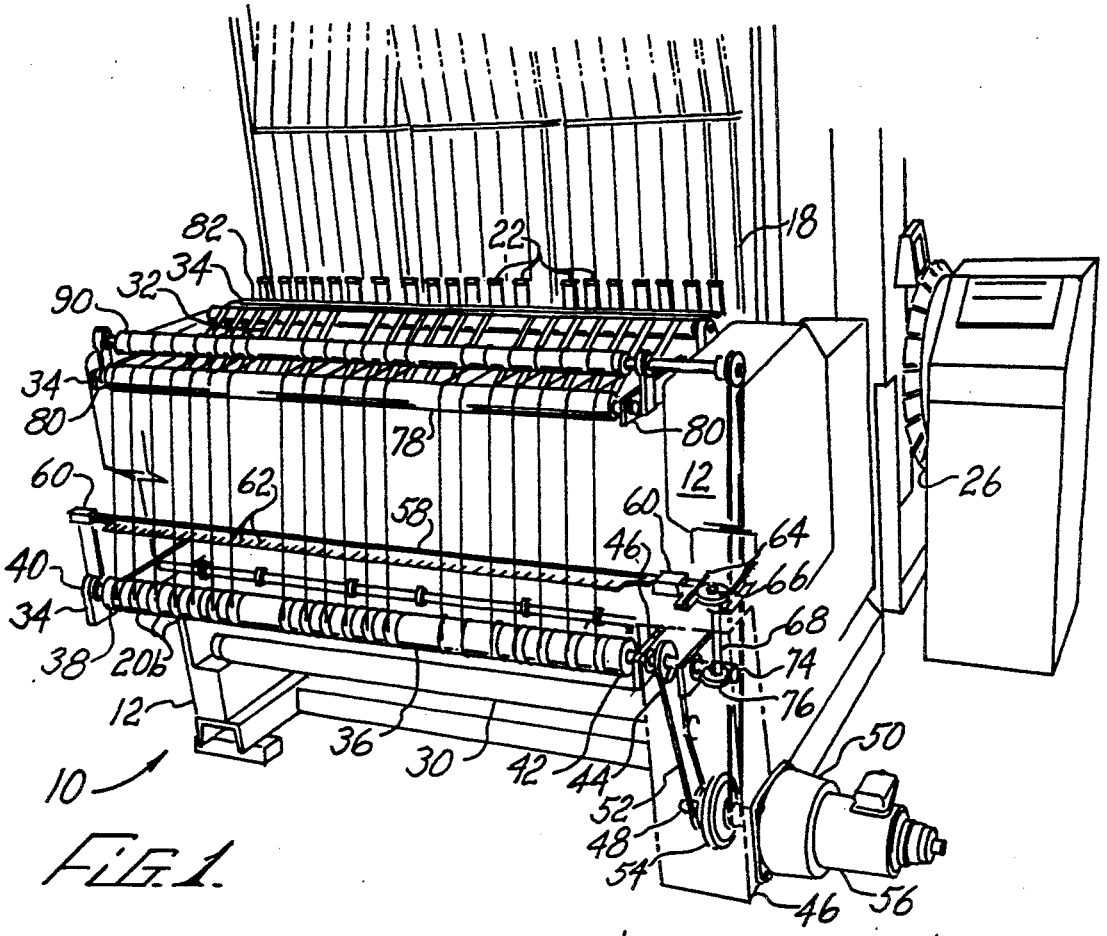
FIG. 1 is a right oblique elevational perspective view of a gang-type loom having apparatus for facilitating set-up for weaving different widths according to the present invention.

The present invention is directed to a method and apparatus for facilitating weaving narrow articles in various widths on a loom, such weaving being typically done on gang-type jacquard looms. With reference to FIGS. 1–4 of the drawings, a gang-type loom 10 includes a housing structure 12, a plurality of weaving heads 14, a jacquard unit 16 supported above the heads 14 for controlling a multiplicity of warp guides or harnesses 18 from which corresponding warp strands 20 are fed into the heads 14. Woven articles proceed through each weaving head 14, being guided by a pair of guide shafts 21, designated lower guide shaft **21*a* and upper guide shaft 21*b*. A slotted reed member 22 is reciprocatingly movable between each weaving head 14 and the associated harnesses 18 for compacting a weft strand (not shown) following successive strokes of a weft needle 24 of the weaving head 14. A main motor 26 of the loom 10 drives the weaving heads 14, the reed members 22, and the jacquard unit 16 in a conventional manner, the harnesses 18 being operated by the jacquard unit 16 for feeding the warp strands 20 in either of two intersecting planes, designated 25*a* and 25*b*, past opposite sides of the path of the weft needle 24, whereby the weft strand is woven selectively on opposite sides of predetermined ones of the warp strands 20 for producing a desired label pattern. The loom 10 also includes a fabric take-off unit 28 and an output spool 30 for forming continuous rolls of woven articles such as garment labels 32. The weaving heads 14 and the associated reed members 22 each provide capability of the loom 10 for weaving the labels 32** to a maximum width $W_M$.

According to the present invention, the loom 10 is equipped with a collection apparatus 34 for collecting unused ones of the warp strands 20, whereby the labels 32 are woven to a desired width $W_1$ that is equal to or less than $W_M$, while permitting a full complement of the warp strands 20 to remain threaded from a warp beam (not shown) and through the harnesses 18 of the loom 10.

The collection apparatus 34 includes a powered, elongate warp collection roller 36 that is rotatably supported in parallel relation to the weaving heads 14, a tail extremity 38 of the roller 36 being supported on a bearing support 40 that is fastened to the housing structure 12 at one side thereof. A driven extremity 42 of the collection roller 36 is releasably coupled to a spindle shaft 44 for drive thereby, the spindle shaft 44 being rotatably supported within a drive frame 46 that is fastened to the housing structure 12 opposite the bearing support 40. The spindle shaft 44 is driven from a clutch shaft 48 of an auxiliary drive 50 by a chain drive 52, the clutch shaft 48 being rotatably supported within the drive frame 46 and coupled through an adjustable slip clutch 54 to a reduction gear motor 56 for drive thereby. The motor 56 is operated in a conventional manner for maintaining the rotational speed of the warp collection roller 36 not less than that required for collecting unused ones of the warp strands 20 thereon under tension from the reed members 22, the slip clutch 54 being adjusted for limiting torque transmitted to the warp collection roller 36 such that a prededetermined maximum tension in each of the unused warp strands 20 is not exceeded.

The apparatus 34 also includes a reciprocating leveling bar 58 that is movably supported between a pair of guides 60 for distributing the unused warp strands 20 axially on the collection roller 36 whereby a winding circumference of the strands 20 is relatively equalized among the strands 20 during progression of the winding as the loom 10 is operated. The leveling bar 58 is oriented in parallel-spaced relation to the collection roller 36, the guides 60 being respectively supported on the bearing support 40 and the drive frame 46. The leveling bar 58 is formed with a large plurality of edge-opening slots 62 therein for guiding groups of the unused warp strands 20 onto the warp collection roller 36, the slots 62 being oriented perpendicular to the roller 36. The leveling bar 58 has a parallel spaced follower arms 64 rigidly affixed thereto for axial movement of the bar 58 in response to rotation of an eccentric cam 66, the cam 66 being laterally slotted and adjustably fastened to a cam shaft 68 by a wing nut 70 for stroke adjustment of the leveling bar 58. The cam shaft 68, rotatably supported relative to the drive frame 46 by a bearing block 72, is driven in synchronism with the warp collection roller 36 by a worm gear 74 and mating worm wheel 76 from the spindle shaft 44. The apparatus 34 also includes an idler roller 78 that is rotatably supported between a pair of idler bearing supports 80 that are mounted to opposite sides of the housing structure 12 above the leveling bar 58, the arrangement of the idler roller 78, the leveling bar 58, and the warp collection roller 36 only minimally increasing required floor space for the loom 10.

Figure 2:
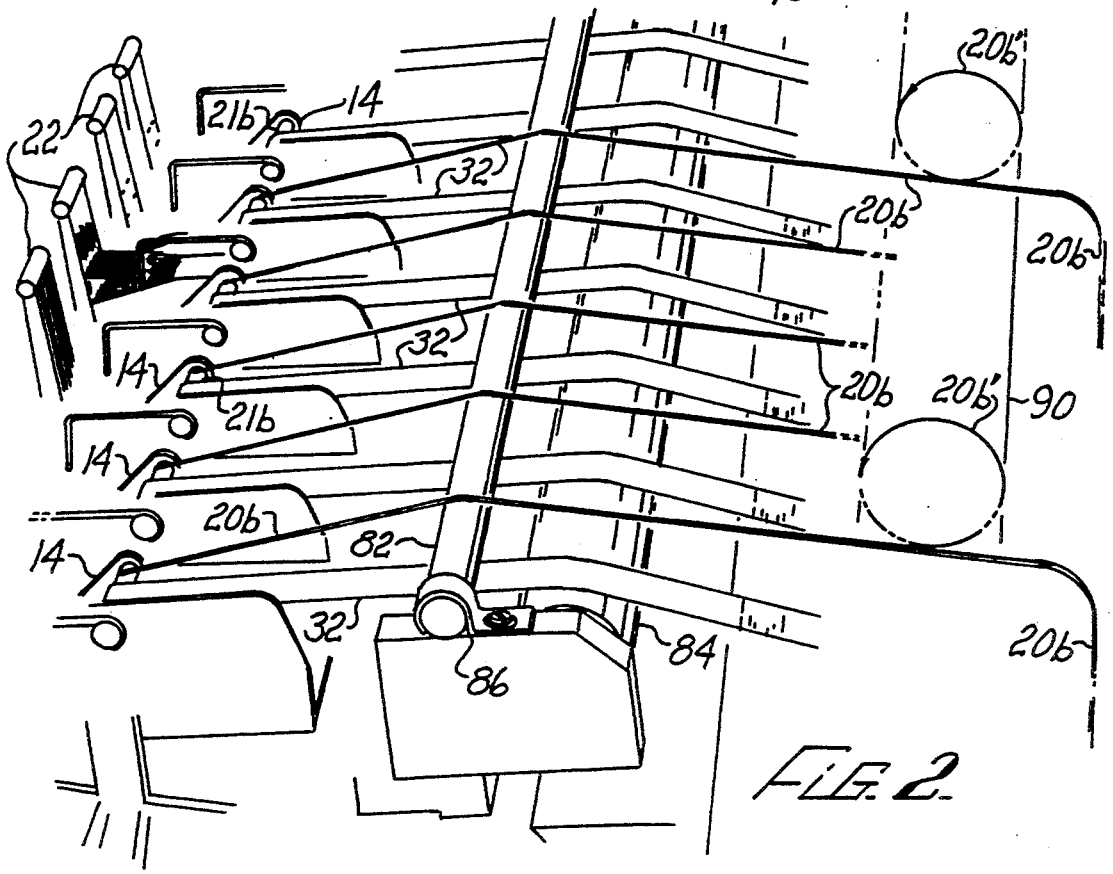
FIG. 2 is a left oblique plan diagrammatic perspective view of a portion of the loom and apparatus of FIG. 1.
Figure 4:
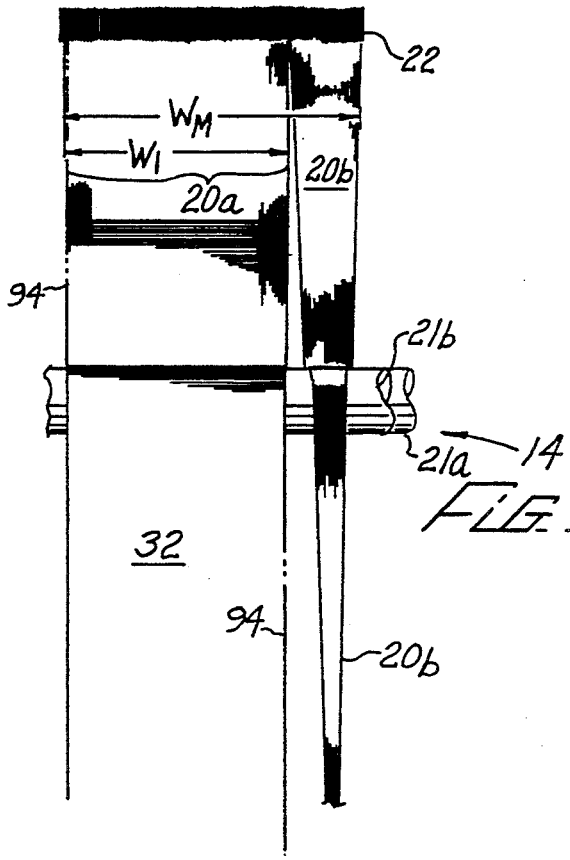
FIG. 4 is an enlarged detail plan view showing strands being woven into woven articles by the loom and apparatus of FIG. 1.

According to the present invention, when it is desired to set-up the loom 10 for reduced width weaving of the labels 32 at the width $W_1$, the warp strands 20 are separated downstream of the reed member 22 into a first group for forming the labels 32, the strands thereof designated **20*a*; and a second group of the unused strands, designated 20*b*, the unused strands 20*b* being fed in laterally spaced relation to the labels 32 as best shown in FIGS. 2 and 4, at least some of the strands 20*b* being wound onto the warp collection roller 36 as described above. Separation of the unused strands 20*b* is maintained during operation of the loom 10 by preventing the weft needle 24 from passing on opposite sides of the strands 20*b*, such as by programming the jacquard unit 16 for holding or restraining the harnesses 18 associated with the strands 20 in positions corresponding to feeding of the warp strands 20 in one plane only of the intersecting planes 25*a* and 25*b*. The path of the unused strands 20*b* diverges slightly from that of the advancing labels 32, horizontally by appropriate selection of the slots 62 for guiding the strands 20*b* onto the warp collection roller 36, and vertically by means of a guide bar 82 of the apparatus 34 that is clamped just above an guide roller 84 of the loom 10 by a pair of clamp members 86 as shown most clearly in FIG. 2**.

Figure 5:
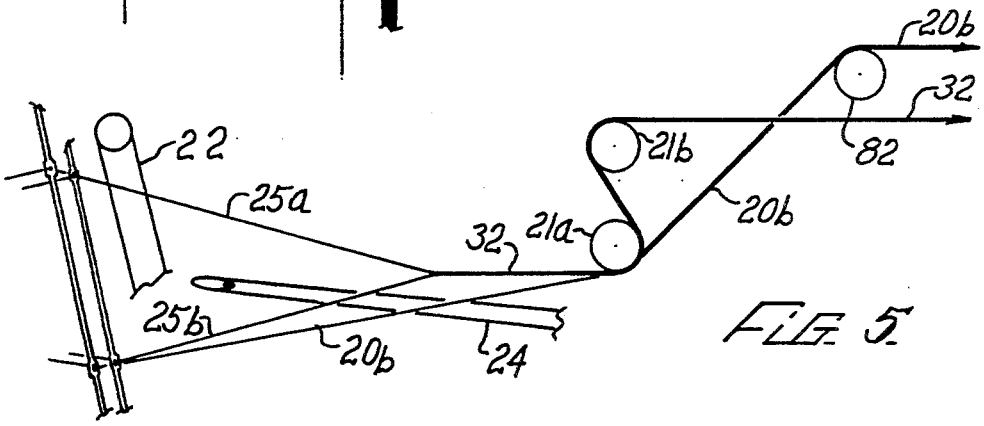
FIG. 5 is a diagrammatic view as in FIG. 3, showing an alternative configuration of the loom and apparatus of FIG. 1.

As shown in the drawings, the strands **20*b* are guided on guide shafts 21*a* and 21*b* along side of the strands 20*a* forming the labels 32. Alternatively, and with further reference to FIG. 5, the strands 20*b* can pass directly from the underside of the guide shaft: 21*a* to the guide bar 82, bypassing the guide shaft 21*b*** for reduced friction and reduced likelihood of breakage.

Figure 3:
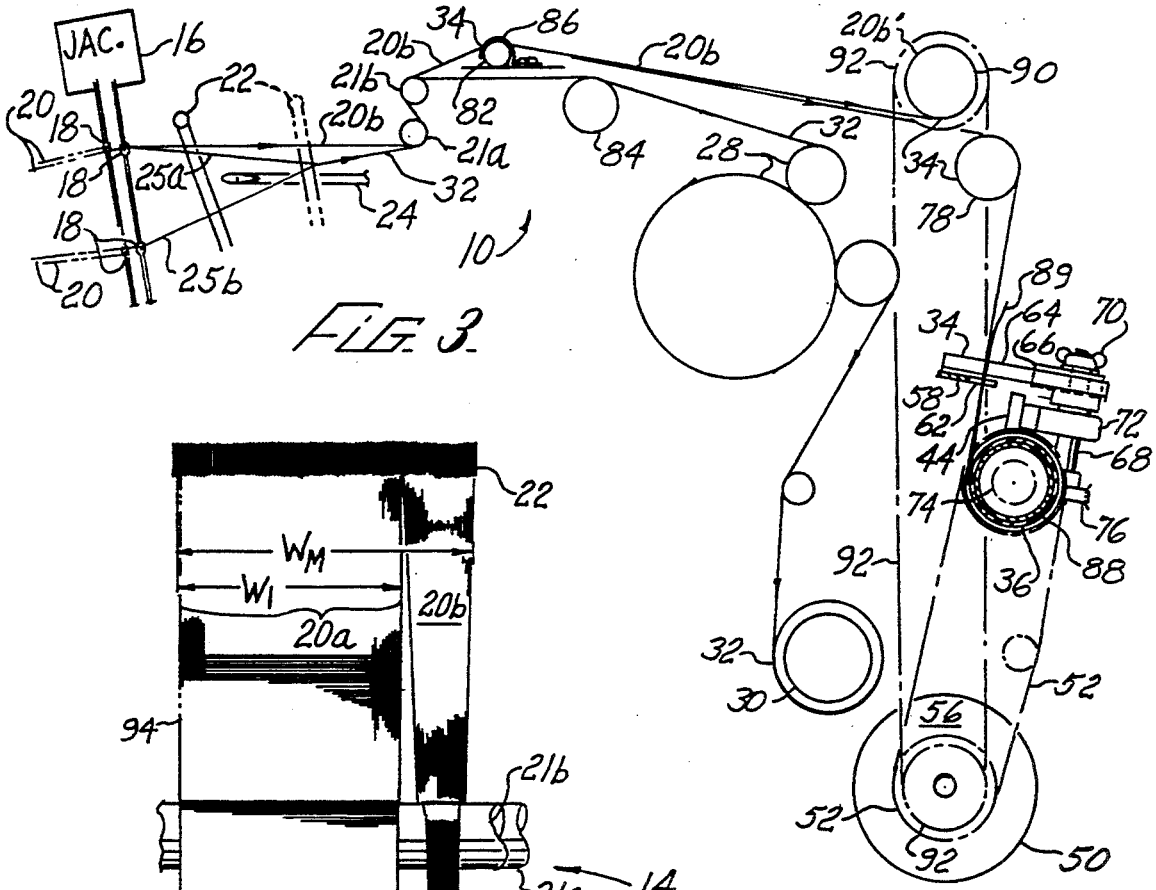
FIG. 3 is an elevational diagrammatic view of the loom and apparatus of FIG. 1.

The warp collection roller 36 preferably is provided with a resilient sheet member or coating 88 for further facilitating maintenance of at least some tension on each of the unused warp strands 20 collected thereon. Also, individual sheet members 89 can be periodically inserted as indicated in FIG. 3 for winding onto the collection roller 36 in interleaved relation to the strands **20*b*. The sheet members 89 can be used either alone or in combination with the coating 88 for equalizing tension among the strands 20*b***.

The warp strands 20 are typically formed of polyester or, less typically of cotton. In many applications, a small number of the warp strands 20 are formed of Nylon monofilament, having significantly different (usually smaller) cross-sectional areas than the others, such that the tension of those strands being collected on the warp collection roller 36 would gradually decrease to the point of undesirably forming loose loops. Accordingly, the apparatus 34 preferably further includes at least one secondary collection roller 90, the roller 90 being rotatably supported by the bearing support 80 above the idler roller 78. The secondary collection roller 90 is powered from the auxiliary drive 50 by an elastic belt drive 92 for loosely maintaining tension on the few unused strands **20*b*** having the different cross-sectional area.

It will be understood that the labels 32 can be woven with selvage portions on opposite sides thereof as indicated at 94 in FIG. 4. Often the warp strands **20*a* for the selvage portions 94 are provided in materials and/or configurations different than that of the other warp strands 20*a*. When setting up the loom 10 for different widths using the apparatus 34 of the present invention, the differently configured warp strands 20*a* for the selvage portion at one side only (approximately 8 to 16 of the strands 20*a*) of the labels 32 are required to be rethreaded to different slots within the reed members 22, and preferably through correspondingly different ones of the harnesses 18. It may be convenient in this operation to rethread the reeds; however, the vast majority of the warp strands 20 are not required to be rethreaded through the harnesses 18**.

Although the present invention has been described in considerable detail with reference to certain preferred versions thereof, other versions are possible. For example, an adjustable guide can be provided at each weaving head 14 for separating the unused warp strands **20*b* from the strands 20*a* as an alternative to programming the jacquard unit 16 for disabling the associated harnesses 18. Also, a second adjustable slip clutch can be used for driving the secondary collection roller 90, rather than relying on the belt drive for limiting the torque thereto. Further, the speed of the auxiliary drive can be synchronized with that of the loom. Moreover, the apparatus 34 can include counterparts of the secondary collection roller 90 for tensioning the strands 20*b*** having correspondingly different cross-sectional areas. Therefore, the spirit and scope of the appended claims should not necessarily be limited to the description of the preferred versions contained herein.

What is claimed is:

1. A method for weaving woven articles in a plurality of widths, comprising the steps of:

(a) providing a weaving loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed members having a multiplicity of slots for receiving and guiding the warp strands in planes intersecting the first and second path planes, the slots being closely spaced for defining a maximum weaving width $W_M$ of the weaving head, the woven articles being serially collected from the weaving head;

(b) separating the warp strands being fed from the reed member into a first group and a second group, the first group including sufficient warp strands for forming the woven articles at a predetermined weaving width $W_1$;

(c) feeding the strands of the first group into the weaving head for forming the woven articles of the predetermined width $W_1$;

(d) feeding the strands of the second group in a bypass path bypassing the woven articles; and (e) maintaining a collection tension in the strands of the second group within the bypass path, the collection tension being sufficient for feeding the strands of the second group from the reed member in unison with the strands of the first group.

2. The method of claim 1, wherein the loom operates at a warp rate of advancing the warp strands, and the step of maintaining the collection tension comprises the steps of:

(a) providing a cylindrical warp collection roll for receiving the strands of the second group;

(b) rotating the warp collection roll using a drive capable of collecting the strands of the second group on the warp collection roll at a rate in excess of the warp rate; and (c) limiting a torque transmitted to the warp collection roll from the drive for maintaining the collection tension without exceeding a predetermined maximum tension of each of the strands of the second group.

3. The method of claim 2, wherein the step of maintaining the collection tension includes the further step of periodically winding a sheet of flexible material on the warp collection roll between layers of the strands of the second group.

4. A method for weaving woven articles in a plurality of widths, the loom operating at a warp rate of advancing the warp strands, comprising the steps of:

(a) providing a weaving loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head;

(b) separating the warp strands from the reed member into a first group and a second group, the first group including sufficient warp strands for forming the woven articles at a predetermined weaving width $W_1$, the strands of the second group including strands having a first cross-sectional area and strands having a different cross-sectional area;

(c) feeding the strands of the first group into the weaving head for forming the woven articles of the predetermined width $W_1$;

(d) feeding the strands of the second group in a bypass path bypassing the woven articles; and (e) maintaining a collection tension in the strands of the second group within the bypass path, the collection tension being sufficient for feeding the strands of the second group from the reed member in unison with the strands of the first group, the step of maintaining the collection tension comprising the steps of:

(i) providing a cylindrical primary warp collection roll for receiving the strands of the second group;

(ii) rotating the primary warp collection roll using a drive capable of collecting the strands of the second group on the primary warp collection roll at a rate in excess of the warp rate; and (iii) limiting a torque transmitted to the primary warp collection roll from the drive for maintaining the collection tension without exceeding a predetermined maximum tension of each of the strands of the second group;

(iv) separating the strands having a different cross-sectional area from the strands of the second group being received on the primary warp collection roll;

(v) providing at least one cylindrical secondary collection roll for receiving the strands of the second group having the different cross-sectional area;

(vi) rotating the secondary collection roll using a coupling to the drive capable of collecting the strands having the different cross-sectional area at a rate in excess of the warp rate; and (vii) limiting a torque transmitted to the secondary collection roll by the coupling for maintaining the collection tension without exceeding the predetermined maximum tension of each of the strands of the second group.

5. The method of claim 4, wherein the step of limiting the torque comprises the steps of using a slip clutch between the drive and the primary warp collection roll, and using an elastic belt in the coupling between the drive and the secondary collection roll.

6. A method for weaving woven articles in a plurality of widths, comprising the steps of:

(a) providing a weaving loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head;

(b) separating the warp strands from the reed member into a first group and a second group, the first group including sufficient warp strands for forming the woven articles at a predetermined weaving width $W_1$, the step of separating the warp strands comprising operating the harnesses for guiding the strands of the second group toward one only of the path planes;

(c) feeding the strands of the first group into the weaving head for forming the woven articles of the predetermined width $W_1$;

(d) feeding the strands of the second group in a bypass path bypassing the woven articles; and (e) maintaining a collection tension in the strands of the second group within the bypass path, the collection tension being sufficient for feeding the strands of the second group from the reed member in unison with the strands of the first group.

7. Apparatus for facilitating weaving woven articles on a loom in a plurality of widths, the loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head, the apparatus comprising:

(a) an auxiliary drive;
(b) a warp collection roll rotatably driven by the auxiliary drive;
(c) a torque limiter connected between the auxiliary drive and the warp collection roll;
(d) a separator including means for being located downstream of the reed member for separating the warp strands passing from the reed member into a first group and a second group, the first group including sufficient strands for forming the woven articles at a predetermined weaving width $W_1$, the separator also including means for directing at least some of the strands of the second group in a bypass path bypassing the woven articles and onto the warp collection roll.

8. The apparatus of claim 7, wherein the torque limiter comprises a slip clutch.

9. The apparatus of claim 8, wherein the second group includes strands having a first cross-sectional area and strands having a different cross-sectional area, the apparatus including at least one secondary collection roll in addition to the warp collection roll.

10. The apparatus of claim 7, wherein the loom includes a plurality of the weaving heads and corresponding reed members, the separator separating the warp strands from each of the reed members into respective first and second groups, at least some of the strands of each of the second groups being received on the primary warp collection roll.

11. The apparatus of claim 7, further comprising a restrainer for restricting movement of the harnesses for the warp strands of the second group for guiding the strands of the second group toward one only of the path planes.

12. Apparatus for facilitating weaving woven articles on a loom in a plurality of widths, the loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head, the apparatus comprising:
(a) an auxiliary drive;
(b) a warp collection roll including means for being located downstream of the weaving head and being rotatably driven by the auxiliary drive;
(c) a torque limiter connected between the auxiliary drive and the warp collection roll;
(d) a separator including means for being located downstream of the reed member for separating the warp strands into a first group and a second group, the first group including sufficient strands for forming the woven articles at a predetermined weaving width $W_1$, and for directing at least some of the strands of the second group in a bypass path bypassing the woven articles and onto the warp collection roll; and
(e) a resilient member on the warp collection roll, the resilient member being variably compressed by the strands of the second group for equalizing tension applied to the strands of the second group.

13. Apparatus for facilitating weaving woven articles on a loom in a plurality of widths, the loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head, the apparatus comprising:
(a) an auxiliary drive;
(b) a warp collection roll rotatably driven by the auxiliary drive;
(c) a torque limiter connected between the auxiliary drive and the warp collection roll;
(d) a separator for separating the warp strands into a first group and a second group, the first group including sufficient strands for forming the woven articles at a predetermined weaving width $W_1$, and for directing at least some of the strands of the second group in a bypass path bypassing the woven articles and onto the warp collection roll; and
(e) a leveling guide for periodically axially displacing the strands of the second group above the warp collection roll, the leveling guide being reciprocally driven from the auxiliary drive.

14. In a loom for weaving woven articles, the loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head, the improvement comprising:
(a) an auxiliary drive;
(b) a warp collection roll rotatably driven by the auxiliary drive;
(c) a torque limiter connected between the auxiliary drive and the warp collection roll;
(d) a separator including means for being located downstream of the reed member for separating the warp strands downstream of the reed member into a first group and a second group, the first group including sufficient strands for forming the woven articles at a predetermined weaving width $W_1$, the separator also including means for directing at least some of the strands of the second group in a bypass path bypassing the woven articles and onto the warp collection roll for facilitating weaving the articles in a plurality of widths.

15. In the loom of claim 14, the loom including a plurality of the weaving heads and corresponding reed members, the improvement further comprising the separator including means for separating the warp strands from each of the reed members into respective first and second groups, at least some of the strands of each of the second groups being received on the primary warp collection roll.

16. In the loom of claim 14, the improvement further comprising a restrainer for restricting movement of the harnesses for the warp strands of the second group for guiding the strands of the second group toward one only of the path planes.

17. A method for weaving woven articles in a plurality of widths, comprising the steps of:

(a) providing a weaving loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head;

(b) separating the warp strands being fed from the reed member into a first group and a second group, the first group including sufficient warp strands for forming the woven articles at a predetermined weaving width $W_1$, the second group including at least one strand;

(c) feeding the strands of the first group into the weaving head for forming the woven articles of the predetermined width $W_1$;

(d) feeding at least one surplus strand of the second group in a bypass path bypassing the woven articles; and (e) maintaining a collection tension in the at least one strand of the second group within the bypass path, the collection tension being sufficient for feeding the at least one strand of the second group from the reed member in unison with the strands of the first group.

18. Apparatus for facilitating weaving woven articles on a loom in a plurality of widths, the loom having at least one weaving head and harnesses for controllably guiding a multiplicity of warp strands between first and second path planes that converge at the weaving head, a reed member reciprocally moving between the harnesses and the weaving head for packing a weft strand into the woven articles, the reed member having a multiplicity of slots for receiving and guiding the warp strands in planes intersecting the first and second path planes, the slots being closely spaced for defining a maximum weaving width $W_M$ of the weaving head, the woven articles being serially collected from the weaving head, the apparatus comprising:

(a) an auxiliary drivel;

(b) a warp collection roll rotatably driven by the auxiliary drive;

(c) a torque limiter connected between the auxiliary drive and the warp collection roll;

(d) a separator for separating the warp strands passing from the reed member into a first group and a second group, the first group including sufficient strands for forming the woven articles at a predetermined weaving width $W_1$, the second group including at least one surplus strand, the separator also including means for directing at least one strand of the second group in a bypass path bypassing the woven articles and onto the warp collection roll.

* * * * *